US006318760B1

(12) United States Patent
Shadle et al.

(10) Patent No.: US 6,318,760 B1
(45) Date of Patent: Nov. 20, 2001

(54) IRREVERSIBLE DISPLAY WITH TEMPORARY IMAGING STAGE

(75) Inventors: Mark A. Shadle; David M. Good, both of Peachtree City, GA (US); Chauncey T. Mitchell, Jr., Lakeland, TN (US)

(73) Assignee: Timer Technologies, LLC, Algoma, WI (US)

( * ) Notice: Subject to any disclaimer, the term of this patent is extended or adjusted under 35 U.S.C. 154(b) by 0 days.

(21) Appl. No.: 09/587,874

(22) Filed: Jun. 6, 2000

(51) Int. Cl.[7] ..... G04B 17/00; K01R 3/00

(52) U.S. Cl. ..... 283/95; 283/17; 283/70; 283/72; 283/96; 283/97; 283/98; 283/901; 283/903; 40/406; 40/407; 40/615; 40/675; 116/206; 428/321.1; 428/321.5; 428/916

(58) Field of Search ..... 283/17, 70, 72, 283/95, 96, 97, 98, 901, 903; 40/406, 407, 615, 625; 116/206, 217; 428/321.1, 321.5, 916

(56) References Cited

U.S. PATENT DOCUMENTS

| | | | | |
|---|---|---|---|---|
| 3,414,415 | * | 12/1968 | Broad, Jr. | 116/206 |
| 4,273,362 | | 6/1981 | Carrier et al. | 283/6 |
| 4,360,548 | | 11/1982 | Skees et al. | 428/29 |
| 4,408,557 | | 10/1983 | Bradley et al. | 116/206 |
| 4,488,646 | | 12/1984 | McCorkle | 206/459 |
| 4,674,771 | | 6/1987 | Thompson, II | 282/8 R |
| 4,726,608 | | 2/1988 | Walton | 283/96 |
| 4,804,275 | * | 2/1989 | Kang et al. | 374/162 |
| 4,903,254 | | 2/1990 | Haas | 368/327 |
| 4,903,991 | | 2/1990 | Wright | 283/95 |
| 4,940,690 | | 7/1990 | Skees | 503/206 |
| 5,058,088 | | 10/1991 | Haas et al. | 368/327 |
| 5,430,277 | | 7/1995 | Ohno et al. | 235/382 |
| 5,431,452 | | 7/1995 | Chang et al. | 283/95 |
| 5,582,434 | | 12/1996 | Skov et al. | 283/81 |
| 5,601,887 | | 2/1997 | Rich et al. | 428/29 |
| 5,602,804 | | 2/1997 | Haas | 368/327 |
| 5,627,356 | | 5/1997 | Takemoto et al. | 235/381 |
| 5,633,835 | * | 5/1997 | Haas et al. | 116/206 |
| 5,667,250 | | 9/1997 | Behm et al. | 283/102 |
| 5,667,303 | * | 9/1997 | Arens et al. | 116/217 |
| 5,707,680 | | 1/1998 | Moore | 427/7 |

* cited by examiner

*Primary Examiner*—Willmon Fridie, Jr.
*Assistant Examiner*—Mark T. Henderson
(74) *Attorney, Agent, or Firm*—Eugene Stephens & Associates; Thomas B. Ryan

(57) ABSTRACT

A metal layer cleared by contact with a chemical clearing agent to reveal an underlying graphics layer is at least partially covered by a buffer material that delays contact with the clearing agent. The buffer material can be applied in a pattern that forms a temporary image in the metal layer prior to more completely revealing the underlying graphics layer.

64 Claims, 7 Drawing Sheets

IRREVERSIBLE DISPLAY WITH TEMPORARY IMAGING STAGE

TECHNICAL FIELD

When activated, irreversible displays undergo permanent changes in appearance. Initially obscured or otherwise hidden information is revealed by the changes of appearance.

BACKGROUND

Changes that take place in irreversible displays generally involve the revelation of indicia, which can range from a patch of color to text and pictures. The indicia can be revealed by chemical or physical agents that change themselves or that produce other changes in the displays. For example, opaque coloring agents can be rendered transparent to reveal underlying indicia, or similar agents can change from one color to another to indicate a change.

Chemical transformations in irreversible displays are sometimes used for security purposes to provide evidence of tampering or counterfeiting. U.S. Pat. No. 4,488,646 to McCorkle hides a warning message behind a solvent-sensitive blush coating to provide evidence of solvent tampering with letters, tickets, and other information-bearing constructions. Upon exposure to a wide range of aromatic or aliphatic solvents, the blush coating is transformed into a transparent state revealing the message. U.S. Pat. No. 4,903,991 to Wright discloses a document security system in which a latent image is developed by rupturing photoactive microcapsules to verify authenticity.

Mechanical transformations are more often used for interactive game pieces. The most common are scratch-off games in which an opaque coating is removed by abrasion to reveal a hidden indicium. Chang et al. in U.S. Pat. No. 5,431,452 separately position a latent image and a removable image-developing device on different portions of a substrate. The image-developing device contains a chromogenic composition that converts the latent image into a visible image.

Commonly assigned U.S. application Ser. No. 09/426,225 entitled "Irreversible Thin Film Display with Clearing Agent", which is hereby incorporated by reference, exploits features of thin metal films for temporarily obscuring indicia from view. Chemical clearing agents clear the metal films to display the indicia. The thin metal films can be cleared to reveal underlying indicia or the indicia can be formed by clearing the metal films in predetermined patterns.

SUMMARY OF INVENTION

We have enhanced performance capabilities and expanded performance options of our irreversible thin metal displays activated by chemical clearing agents. Our new displays include capabilities for producing dynamic imaging effects such as forming temporary or evolving images by controlling rates at which different portions of the metal films are cleared. For example, the differential clearing rates can be used to form a temporary image in the metal film, which eventually clears to reveal a more permanent underlying image.

An exemplary irreversible multistage display includes a metal layer having first and second portions. A first graphics layer underlies both portions of the metal layer. A second graphics layer is laid out in a pattern on the first portion of the metal layer. Preferably, neither graphics layer is apparent at first. The two portions of the metal layer are differentially accessible to a chemical clearing agent that produces a chemical reaction for clearing the metal layer. As a result, the first and second portions of the metal layer clear at different rates temporarily displaying the pattern of the second graphics layer in the metal layer in advance of more permanently displaying the underlying first graphics layer.

Part of the more permanent image (i.e., the first graphics layer) made visible by clearing the second portion of the metal layer preferably provides contrast for viewing the temporary image (i.e., the pattern of the second graphics layer) in the first portion of the metal layer. The second graphics layer is preferably laid out using a material that influences the relative rates at which the first and second portions of the metal layer are cleared. For example, bonding characteristics of the second graphics layer to the metal layer can be adjusted to delay access of the clearing agent to the metal layer. Inks formulated to partially bond with the metal layer are particularly suitable for this purpose.

An exemplary irreversible display system for producing a temporary display of information includes both a metal layer and a chemical clearing agent, which are initially maintained out of operative contact with each other within a display region. A pattern formed on the metal layer within the display region encodes the information. Moving the clearing agent and the metal layer into operative contact with each other initiates a chemical reaction for clearing the metal layer. The pattern is composed of a buffer material that delays clearing of the patterned portion of the metal layer to temporarily display the encoded information.

Preferably, the buffer material is printed on the metal layer and contains an anti-bonding agent that reduces adherence of the buffer material to the metal layer. Additional patterns that delay clearing by different amounts can be formed on the metal layer to display an evolving message or a succession of different messages. More delay can be achieved by increasing the bonding strength of the buffer materials to the metal layer.

The desired buffer materials can be arranged for encoding information or for controlling the manner in which underlying images are revealed. For example, the buffer materials can regulate clearing of the metal layer from outside-in, side-to-side, or top-to-bottom or through a speckle pattern to enhance interest in the underlying image. Temporary block-out patterns can also be formed on the metal layer to deny viewing access to the underlying images before the metal film is cleared. Alternatively, the desired buffer material can be applied as a continuous coating to regulate access of the chemical clearing agent to the metal layer. For example, a continuous coating of the buffer material can be used to protect that metal layer from unintended environmental influences or to provide a temporary barrier to the chemical clearing agent.

The metal layer is preferably composed of a metal, such as zinc, silver, or aluminum that is sputtered or vapor deposited onto a clear film. The clearing agent can be drawn from a variety of materials including electrolytes, acids, bases, and other agents that participate in localized reactions for corroding or otherwise clearing the metal layer. Among the choices are many safe and environmentally friendly materials including edibles such as juices, carbonated beverages, and even condiments.

The preferred reactions that clear the metal layer are localized electrochemical reactions that oxidize the metal layer. In contrast to galvanic or electrolytic electrochemical reactions, the localized electrochemical reactions between the clearing agent and the metal layer produce a mixed electropotential and do not require a net flow of current through the metal layer. However, displays with metal layers cleared by galvanic or electrolytic reactions could also benefit from the invention.

Our irreversible displays can be manufactured by an in-line press. All of the layers including substrates, metal films, clearing agents, graphics, adhesives, and spacers can be formed from individual webs or from layers applied to the individual webs. The result is a succession of thin flexible displays that can be manufactured quickly at low cost and integrated if desired with other press-produced or otherwise compatible articles.

DRAWINGS

DETAILED DESCRIPTION

Figure 1:
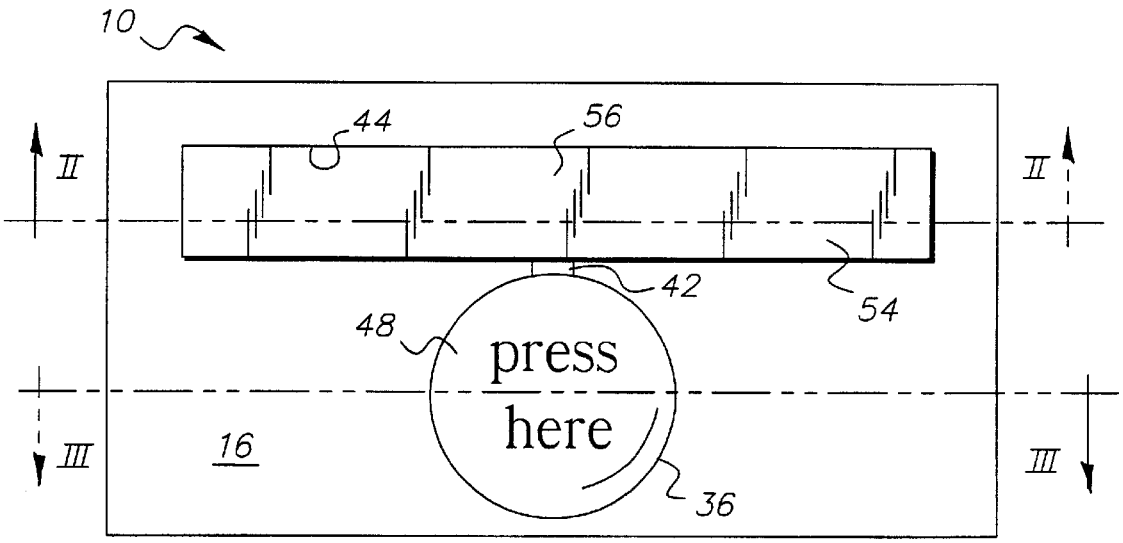
FIG. 1 is a plan view of an irreversible multistage display activated by squeezing a clearing agent from a reservoir.
Figure 2:
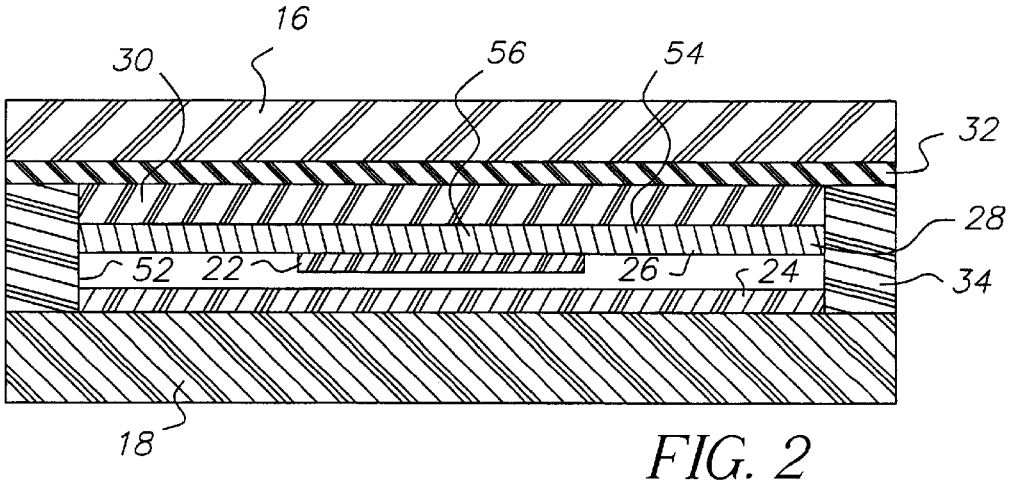
FIG. 2 is a cross-sectional view of the display taken along line II—II of FIG. 1.
Figure 3:
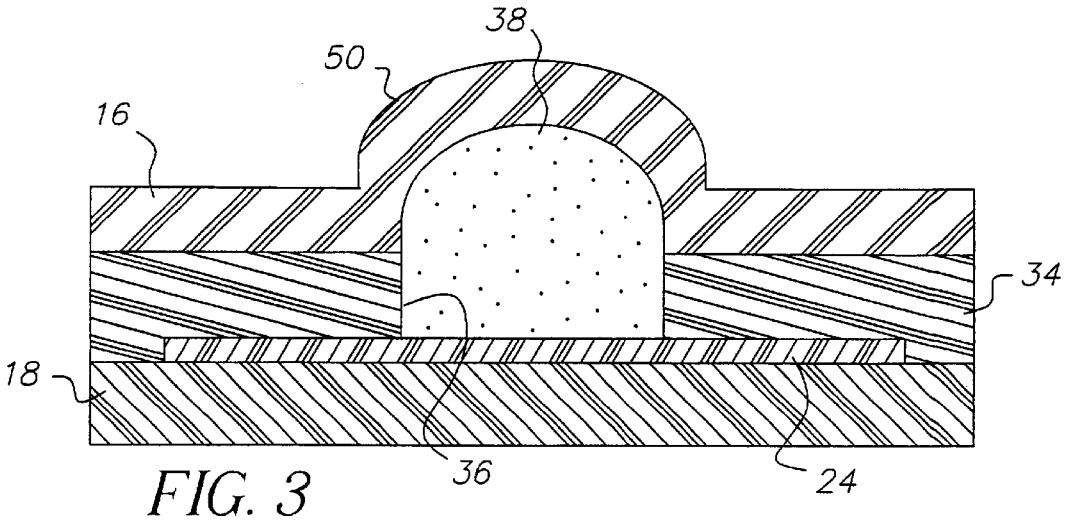
FIG. 3 is a cross-sectional view of the display taken along line III—III of FIG. 1.
Figure 4:
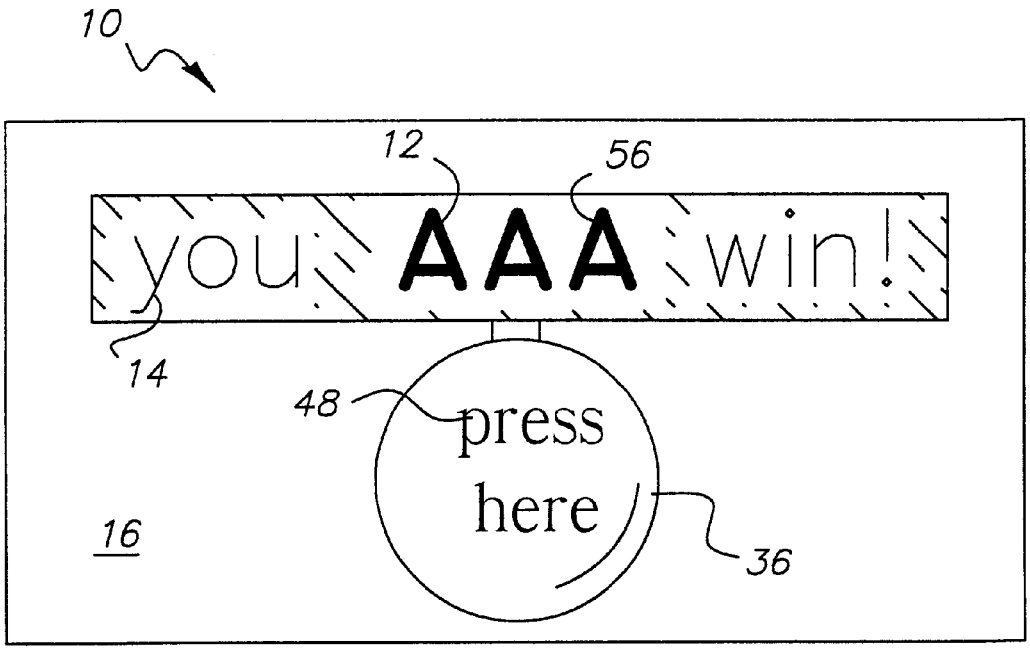
FIG. 4 is another plan view of the same display showing a partially cleared metal film forming a temporary pattern that continues to block a portion of an underlying graphics layer.
Figure 5:
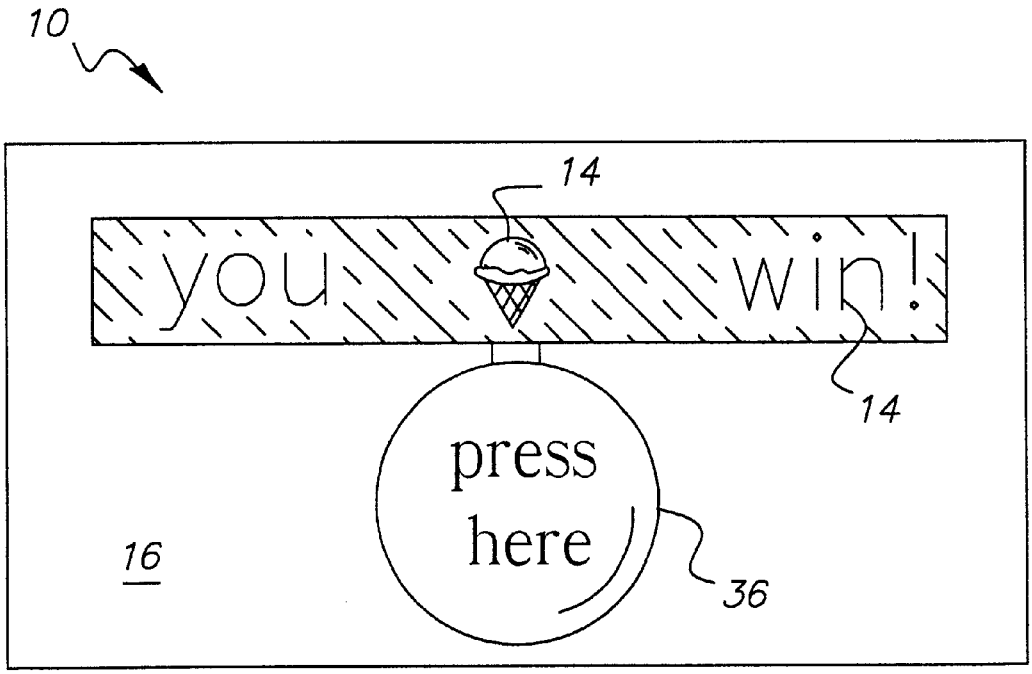
FIG. 5 is another plan view of the same display showing an underlying graphics revealed after the metal film has completely cleared.

An exemplary irreversible multistage display 10 shown throughout FIGS. 1–5 displays both a temporary indicium (i.e., message) 12 and a more permanent indicium (i.e., message) 14. Neither indicium 12 or 14 is visible at first.

Top and bottom substrates 16 and 18 support between them a number of layers including a first graphics layer 22 that encodes the temporary indicium 12 and a second graphics layer 24 that encodes the more permanent indicium 14. The first graphics layer 22 is laid out in a pattern on a bottom surface 26 of a metal layer 28. A clear film 30 bonded to the top substrate 16 with an adhesive layer 32 provides immediate support for the metal layer 28. A surrounding adhesive layer 34 bonds the two substrates together, leaving space for a pocket reservoir 36 that confines a chemical clearing agent 38 and for a gated pathway 42 that provides for conducting the clearing agent to the bottom surface 26 of the metal layer 28. More than one gated pathway 42 in combination with the reservoir 36 or additional reservoirs can be provided for directing the clearing agent 38 to multiple locations on the metal layer 28.

The top substrate 16 is preferably transparent at least in a windowed area 44 (i.e., a display region) aligned with the metal layer 28 and the two indicia 12 and 14. The bottom substrate 18 (also referred to as a base substrate) is preferably opaque to block viewing access to the two indicia 12 and 14. Both can have single-ply or a multi-ply constructions made from a variety of materials including paper or plastic. For example, the top and bottom substrates 16 and 18 can be formed from a combination of low-density polyethylene (LDPE), high density polyethylene (HDPE), and polyethylene terephtalate (PET). The substrate materials are preferably adaptable for web transport.

The graphics layer 24 also includes an indicium 48 in the form of an instructional message "press here", which is viewable through both the top substrate 16 and the clearing agent 38 to provide instructions for activating the display 10. Other indicia can be located elsewhere between the top and bottom substrates 16 and 18 to further enhance the appearance or function of the display 10. Conventional printing techniques with ink, such as flexographic printing, can be used to form the graphics layers. Within each such layer, the ink can be applied in a variety of patterns, colors, and degrees of opacity to create the desired images.

A bulge 50 in the top substrate 16 provides additional space for confining a clearing agent 38 within the reservoir 36. Vacuum pressure, heat, or stamping can be used to form the bulge 50. An intervening layer such as a spacer (not shown) could also be used to add depth to the reservoir 36. The adhesive layer 34, which is preferably a pressure-sensitive adhesive, provides a seal around the reservoir 36 to confine the clearing agent 38 and to isolate the clearing agent 38 from unwanted environmental influences. In place of or in addition to the adhesive layer 34, an ultrasonic or heat seal could be formed between the top and bottom substrates 16 and 18 to achieve similar ends.

The gated pathway 42 is initially closed to separate the clearing agent 38 from the metal film 28 but can be opened by application of pressure to the reservoir 36. The initially closed and later opened valve function of the gated pathway 42 can be accomplished by forming a weaker bond between the substrates 16 and 18 across the gated pathway 42 than elsewhere surrounding the reservoir 36. A weaker adhesive, a release agent, or a cooler heat seal could be used for this purpose. The length of the gated pathway 42 can also be adjusted to influence the valve function.

The metal layer 28 is preferably a smooth uniformly thin layer of sputtered or vapor-deposited metal, such as zinc, aluminum, or silver, bonded by its manufacturing technique to the clear film 30. Another ink layer 22 is laid out in a pattern on the metal layer 28. Alternatively, both the metal layer 28 and the clear film 30 could be replaced by a self-supporting foil that is thin enough to clear at a desired rate in the presence of the clearing agent 38. For example, the foil could be laminated or transfer printed onto the top substrate 16. Unless otherwise impeded, such as by the graphics layer 22, the metal layer 28 should clear in less than one minute for most applications. Metal layer thicknesses between 100 Angstroms and 1000 Angstroms can be cleared at the desired rate. The metal layer is preferably highly reflective to further obscure the underlying indicium.

The graphics layer 22, which is laid out on the metal layer 28, is preferably composed of a printable buffer material such as an ink, adhesive, wax, or varnish that is arranged to bond only weakly with the metal layer 28. For example, a flexographic ink can be modified by the addition of a surfactant that reduces bonding strength between the metal layer 28 and the graphics layer 22. The bottom surface 26 of the metal layer 28 could also be treated (e.g., reducing polar sites) to make the surface 26 less receptive to bonding with the buffer material.

The chemical clearing agent 38 preferably takes the form of a liquid or gel, such as a hydrogel, that is movable (e.g., squeezable) from the reservoir 36 through the gated pathway 42 over the surface 26 of the metal film 28. A wide variety of materials can function as clearing agents including oxidants, acids, salts, and alkalis, as well as combinations of these groups of materials. Other materials including thickeners (e.g., hydrogels) can be added to adjust physical properties such as viscosity, yield value, and surface tension to achieve desired flow and coverage characteristics. Preferred mixtures contain materials that are safe and environmentally friendly. One example formulated for clearing a zinc film contains the following combination of materials:

49% water

35% citric acid

15% potassium chloride

1% gel medium (thickener)

Squeezing the bulge 50 forces the clearing agent 38 from the reservoir 36 through the gated pathway 42 and over the surface 26 of the thin metal film 28. A space 52 between the metal film 28 and the graphics layer 24 provides clearance for distributing the clearing agent 38 across the metal film 28. In just a few seconds (e.g., 5 seconds) following exposure to the clearing agent 38, a portion 54 of the metal film 28 that is not covered by the graphics layer 22 disappears revealing at least part of the underlying indicium 14. A remaining portion 56 of the metal film 28 that is covered by the graphics layer 22 lingers to form the temporary indicium 12, which is revealed in contrast to the underlying indicium 14. In time (e.g., 30 seconds), the remaining portion 56 of the metal film 28 disappears, revealing any remaining parts of the underlying indicium 14.

The thickness or composition of the metal film 28 as well as the amount and composition of the clearing agent 38 can be adjusted to control the rate of clearing the metal film portion 54. Protective characteristics of the graphics layer 22, such as bonding strength, can be adjusted to control the additional time required to clear the metal film portion 56. For example, the amount of surfactant in the graphics layer 22 can be reduced to increase the amount of time required to clear the metal film portion 56. Pigments or dyes are generally not needed in the graphics layer 22 because the temporary indicium 12 is formed in the remaining portion 56 of the metal film. The oxidation, dissolution, or other disappearance of the thin metal film is irreversible.

In addition to encoding information for temporary display, the graphics layer 22 can perform a number of other functions in relation to the graphics layer 24. For example, the graphics layer 22 can be printed in a pattern (e.g., a random pattern) to further block viewing access to the underlying indicium 14 through either substrate 16 or 18. The color of the graphics layer 22 can be matched with the color of underlying portions of the indicium 14 to provide additional obscuration.

The thickness or composition of the graphics layer 22 can be varied with position to control the order in which the metal film 28 clears to reveal the underlying indicium 14. For example, the graphics layer 22 can be applied with increasing bonding properties (e.g., decreasing concentrations of surfactant) toward a center of the metal film 28 so that the metal film progressively or step-wise clears from a periphery toward the center of the metal film 28. Side-to-side, top-to-bottom, and other orders of clearing the metal film, including speckle patterns and progressions from multiple sites, can be achieved by similar modifications to the graphics layer 22.

Graphic artists can exploit the temporary imaging possibilities of the graphics layer 22 in combination with the graphics layer 24 and any overlying or intervening graphics layers to produce an evolving image or to transform one image into another. Spacing between the metal film 28 and the graphics layer 24 can be exploited to achieve aspects of depth perspective. The clear film 30 supporting the metal layer 28 can be embossed or micro-embossed to other visual effects.

Figure 6:
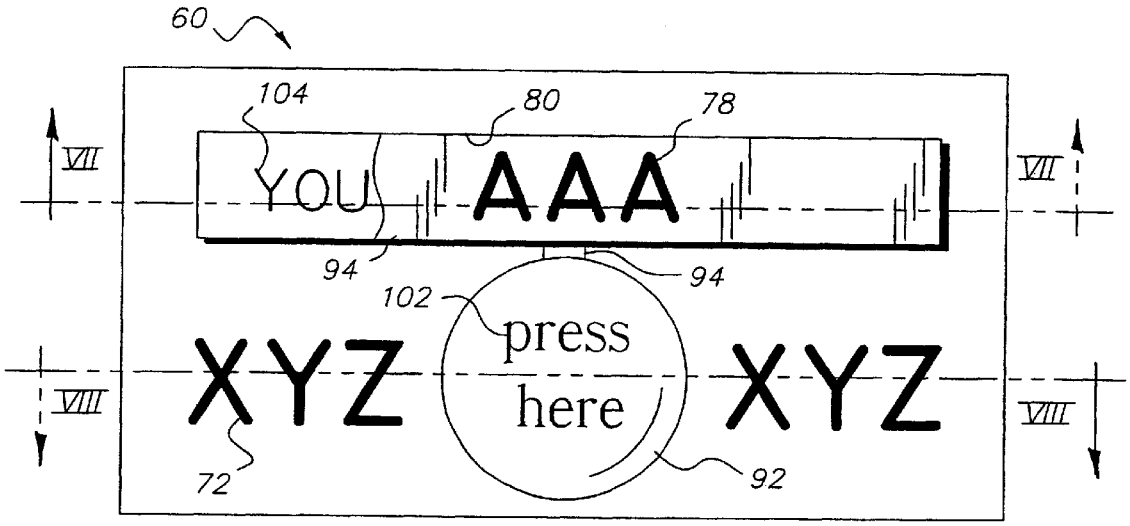
FIG. 6 is a plan view of an alternative multistage display with a different arrangement of layers.
Figure 7:
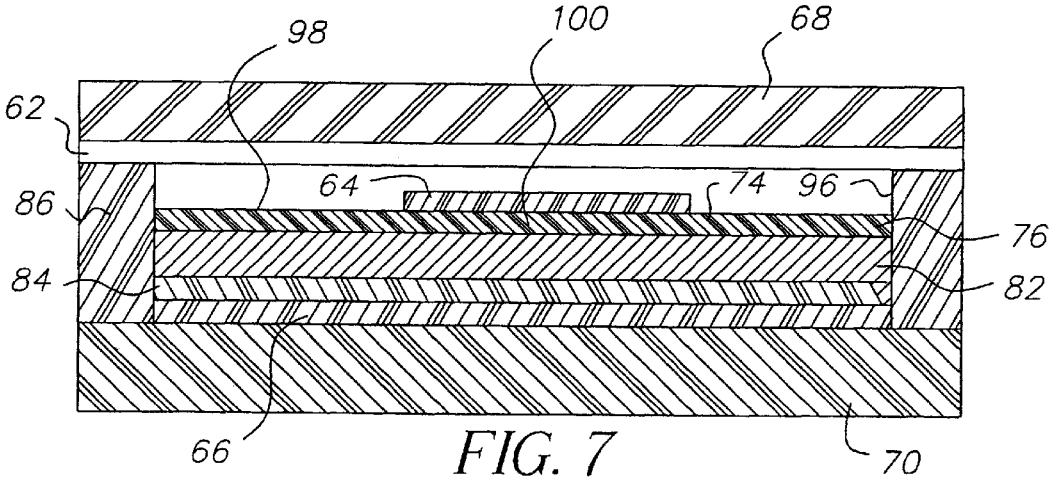
FIG. 7 is a cross-sectional view of the alternative display taken along line VII—VII of FIG. 6.
Figure 8:
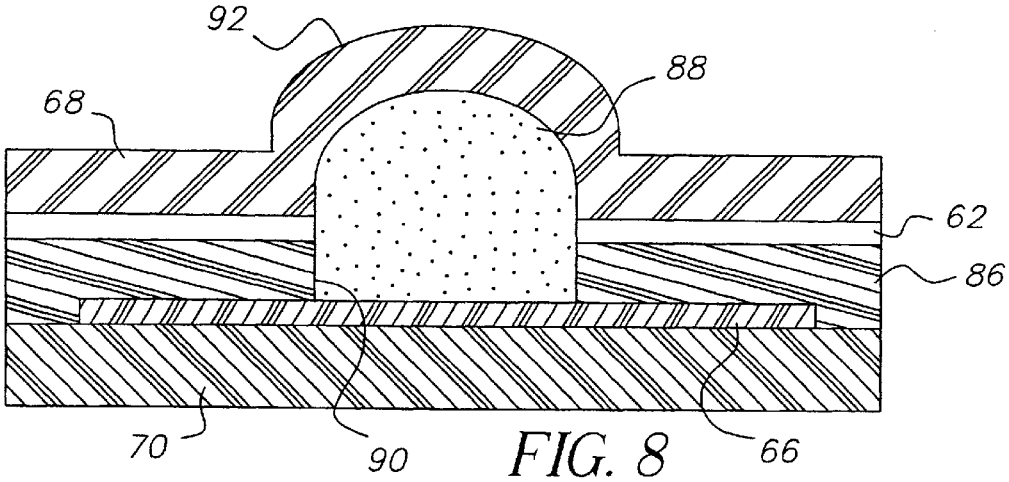
FIG. 8 is a cross-sectional view of the alternative display taken along line VIII—VIII of FIG. 6.

Another multistage display 60 shown in FIGS. 6–8 includes a similar combination of layers in a different order. Three graphics layers 62, 64, and 66 are located between a top substrate 68 and a bottom substrate 70. The graphics layer 62 is printed on the top substrate 68 and preferably includes indicia 72 visible through the top substrate 68 without blocking any desired views of the underlying graphics layers 64 and 66. The graphics layer 64 is laid out (e.g., printed) on a top surface 74 of a metal layer 76. Unless laid out using a transparent or non-contrasting color, an indicium 78 of the graphics layer 64 is preferably visible within a display region 80 through the top substrate 68. The graphics layer 66 is printed on the bottom substrate 70 similar to the preceding embodiment.

The metal layer 76 supporting the graphics layer 64 is itself supported on a clear film 82. Adhesive layer 84 bonds the clear film to the bottom substrate 70. A surrounding adhesive layer 86 bonds the top and bottom substrates 68 and 70 together as well as enclosing a clearing agent 88 within a reservoir 90. A bulge 92 formed in the top substrate 68 expands the reservoir 90 in depth. Similar options are available for constructing and assembling the various layers as in the preceding embodiment. Activation by squeezing the clearing agent 88 through a gated pathway 94 into contact with the top surface 74 of the metal layer 76 is also similar. However, a clearance space 96 for distributing the clearing agent 88 is formed between the metal layer 76 and the overlying graphics layer 62.

The indicium 78 of the graphics layer 64 is initially visible if contrasted with the view of the underlying metal layer 76 but is at least temporarily visible in contrast with the underlying graphics layer 66 upon clearing a portion 98 of the metal layer 76 that is not covered by the graphics layer 64. The duration of the indicium 78 once the metal portion 98 has cleared is controlled by buffering characteristics of the graphics layer 64. For example, stronger bonding between the graphics layer 64 and the metal layer 76 delays clearing of a remaining metal portion 100 supporting the graphics layer 64.

The graphics layer 66 contains two indicia 102 and 104. The indicium 102 is initially visible through the clearing agent 88 and the top substrate 68 to provide instructions for activating the display. Alternatively, the graphics layer 66 or any other graphics layer visible on or through the top substrate 62 could provide similar instructions or other information. The indicium 104 underlies the metal layer 76 and becomes visible in stages associated with the successive clearing of the two portions 98 and 100 of the metal layer 76.

The three graphics layers 62, 64, and 66 can cooperate to produce a succession of different images that can replace, transform, or evolve from one another. Buffering characteristics of the graphics layer 64 can be varied with position to produce progressive or step-wise changes in the display. The indicium 78 could also be arranged to form a block-out pattern to further obscure the underlying indicium 104 until the metal film 76 has cleared. The changes produced by clearing the metal film 76 are irreversible.

Figure 9:
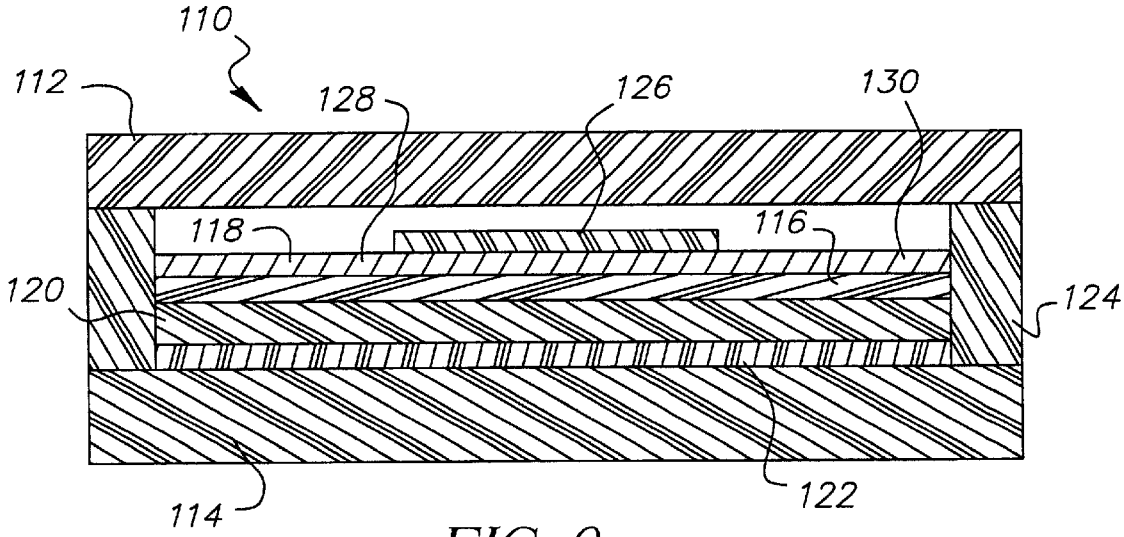
FIG. 9 is a cross-sectional view of another alternative display with a graphics layer interposed between a metal layer and its immediate support.

A multistage display 110 shown in FIG. 9 is activated similar to the preceding embodiments but includes a different arrangement of layers between top and bottom substrates 112 and 114. Most significantly, a graphics layer 116 is located between a metal layer 118 and a support film 120. An adhesive layer 122 fixes the support film 120 to the bottom substrate 114, and a surrounding adhesive layer 124 joins the top and bottom substrates 112 and 114. Similar to the preceding embodiments, different bonding methods can be employed to assemble the display 110, including heat or ultrasonic sealing techniques.

A graphics layer 126 composed of a buffer material is laid out on a first portion 128 of the metal layer 118. The graphics layer 126 can be transparent or simply lack contrast with the appearance of the metal layer 118 to remain hidden initially, or the graphics layer 126 can present a contrasting image that is immediately apparent through the top substrate 112. Either way, any pattern formed with the graphics layer 126 preferably becomes apparent in contrast with the underlying graphics layer 116 after a second portion 130 of the metal layer 118 has cleared. Eventually, the first portion 128 of the metal layer 118 also clears resulting in both the disappearance of any patterns formed with the graphics layer 126 and the appearance of any remaining portions of the graphics layer 116.

The display 110 is particularly suitable for protecting information contained in the graphics layer 116 from tampering. Viewing access to the graphics layer 116 is temporarily blocked by the metal layer 118, which is preferably sputtered or otherwise deposited onto the graphics layer 116. Once removed, the metal layer 118 cannot be easily restored short of re-manufacturing the display 110. Additional graphics layers and other arrangements of the overlying graphics layer 126 can contribute to the evolution or the final appearance of the display 110.

Figure 10:
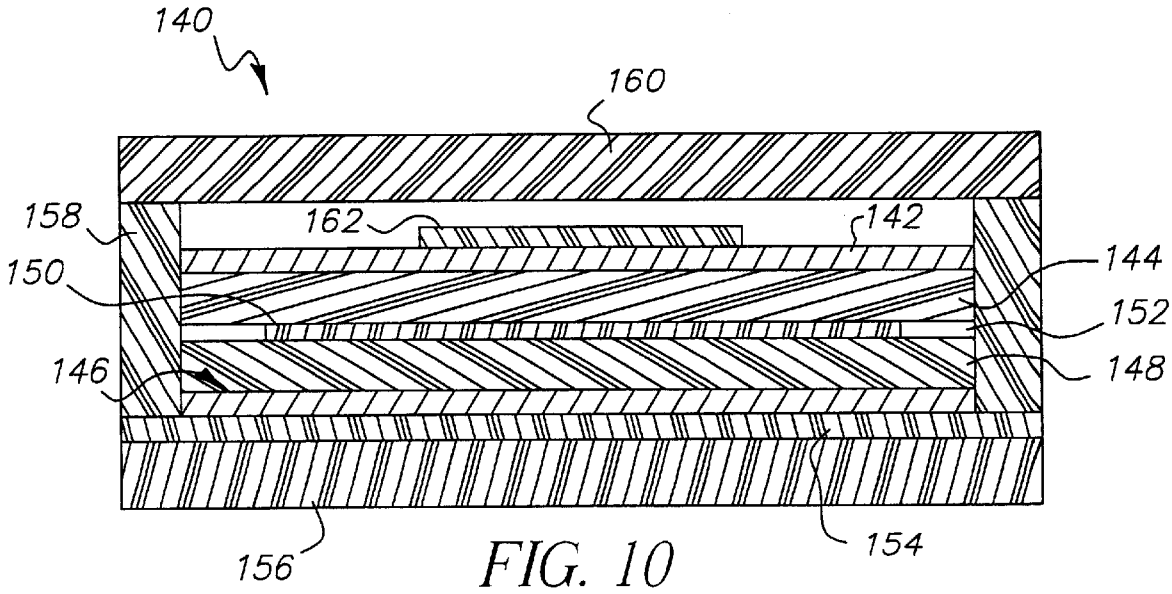
FIG. 10 is a cross-sectional view of another alternative display with multiple layers of metal.

Another irreversible display 140 suitable for protecting graphics information is shown in FIG. 10. A first metal layer 142 is supported on a clear film 144, and a second metal layer 146 is supported on a film 148 that is preferably opaque. A graphics layer 150 is laid out between the two films 144 and 148, which are otherwise bonded together by a permanent adhesive layer 152 or other permanent sealing technique. Either film 144 or 148 can provide immediate support for the graphics layer 150, or a separate substrate (not shown) can be mounted between the films 144 and 148 for supporting the graphics layer 150. An adhesive layer 154 bonds the film 148 to a bottom substrate 156, and a surrounding adhesive layer 158 bonds a top substrate 160 to the bottom substrate 156. Again, different bonding methods are possible.

Viewing access to the graphics layer 150 is blocked from opposite directions by the two metal layers 142 and 146. Opaque substrates 148 and 156 cooperate with the metal layer 146 to deny viewing access from a bottom of the display. Additional graphics layers including block-out patterns can be used to augment this function. A graphics layer 162 laid out on the metal layer 142 and can also be arranged to form a block-out pattern to restrict viewing of the underlying graphics layer 150 through the top substrate 160.

Upon activation (e.g., moving a clearing agent into contact with the metal layer 142), the graphics layer 162 disappears with the clearance of the metal layer 142 to reveal the contents of the hidden graphics layer 150. Preferably, the graphics layer 162 is composed of a buffer material that delays clearing an underlying portion of the metal layer 142 to provide temporary protection or to enhance visual characteristics of the display 140 as described for the preceding embodiments.

Figure 11:
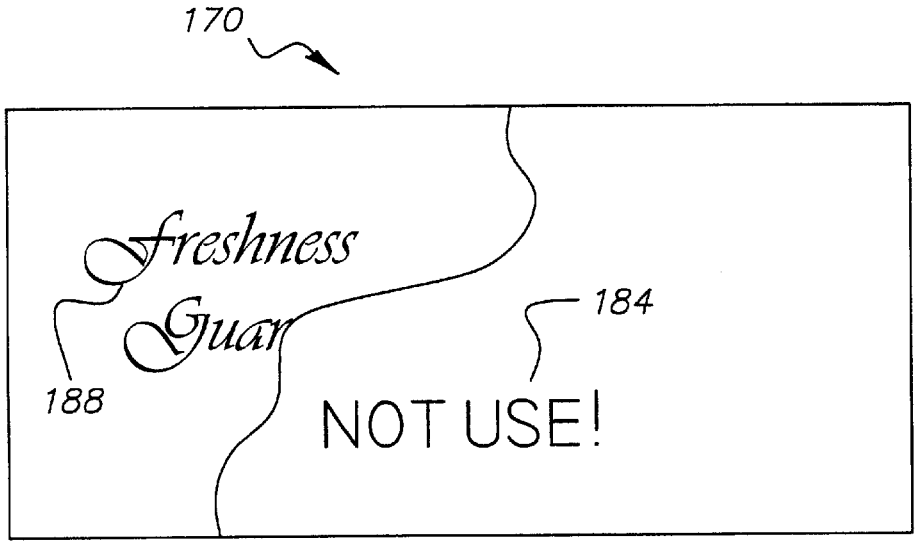
FIG. 11 is a plan view of an irreversible thaw detector display that is partially cut-away to show an underlying graphics layer.
Figure 12:
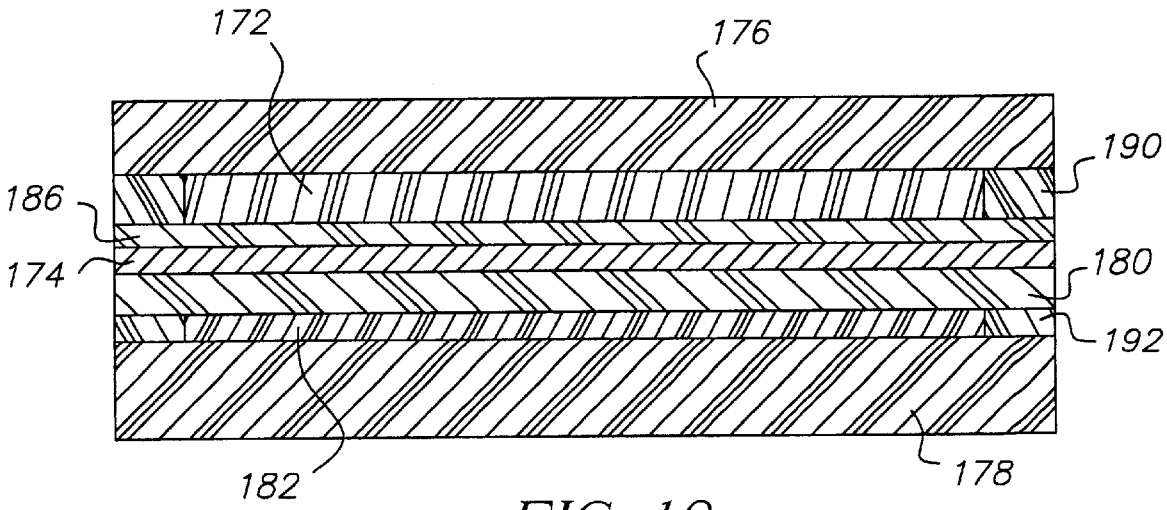
FIG. 12 is a cross-sectional view of the thaw detector.

The temporary protection function of the buffering material is further exemplified in FIGS. 11 and 12. Irreversible display 170, which is arranged to function as a thaw indicator, confines a frozen clearing agent layer 172 and a metal layer 174 in an overlapping relationship between top and bottom substrates 176 and 178. The metal layer 174 is supported on a clear film 180 that overlies a graphics layer 182 containing a thaw warning indicium 184. A buffer layer 186 containing an optional indicium 188 visible through the top substrate 176 separates the frozen clearing agent layer 172 from the metal layer 174. Adhesive layers 190 and 192 bond the top and bottom substrates 176 and 178 to the clear film 180 and provide a seal for confining the clearing agent layer 172 in a liquid or gel form. Other bonding techniques, including direct sealing methods, can be used in addition to or as alternatives to the adhesive layers 190 and 192.

In addition to possibly containing the indicium 188, the buffer layer 186 is preferably composed of a buffer material laid out (e.g., flood coated) over a continuous area of the metal layer 174 or over one or more areas sufficient to block viewing access to the underlying warning indicium 184. The buffer material delays access of the clearing agent to underlying portions of the metal layer 174 for a predetermined interval of time. For example, the clearing agent can be added to the display 170 in a liquid form, which is active for clearing the metal layer 174 and subsequently chilled into a frozen form, which is not active for clearing the metal layer 174. The buffer layer 186 protects the metal layer 174 from the effects of the clearing agent until the clearing agent is frozen into an inactive state. However, if the irreversible display 170 is subsequently thawed for a predetermined additional length of time, the metal layer 174 is cleared to reveal the warning indicium 184.

The thickness, composition, pattern, and distribution of the buffer layer 186 can be varied to control the rate and form of access of the clearing agent to the metal layer 174. For example, the buffer layer 186 can provide access to the metal layer 174 from single or multiple sites or support directional clearing of the metal layer 174, such as a fuel gauge effect, to record the duration of intermittent thawing.

Figure 13:
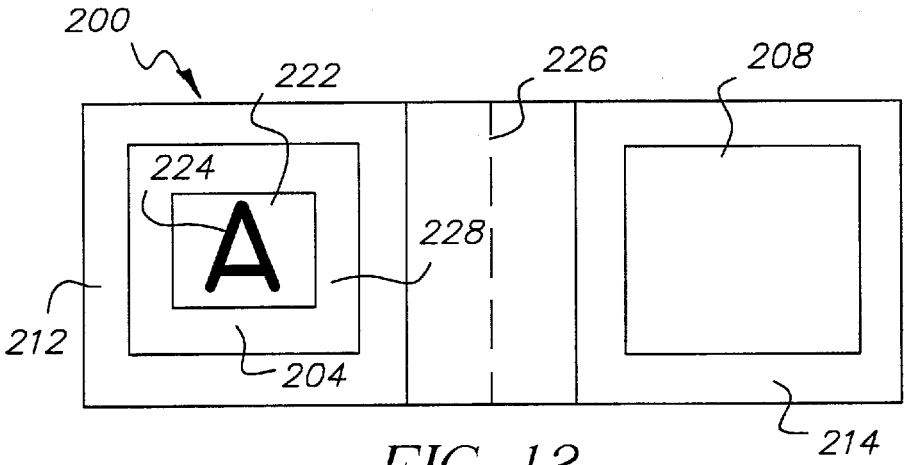
FIG. 13 is a plan view of irreversible multistage display that is activated by folding with a protective liner removed to show interior compartments.
Figure 14:
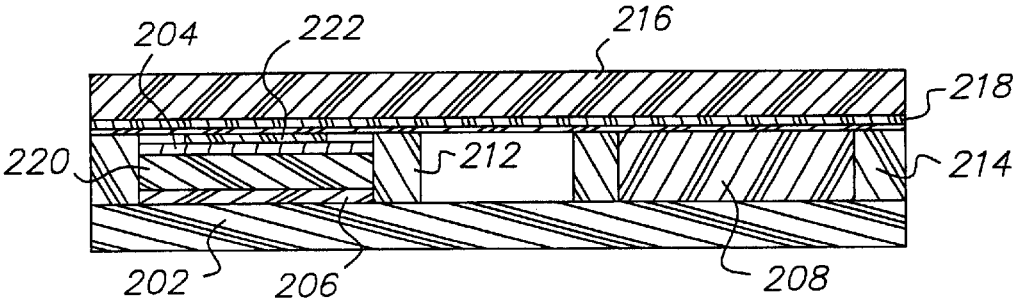
FIG. 14 is a cross-sectional view of the foldable display with the liner in place.
Figure 15:
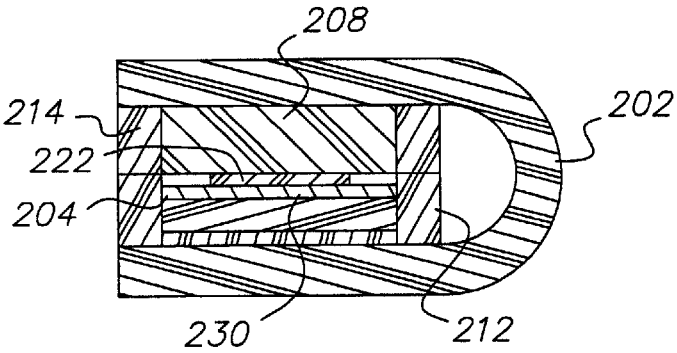
FIG. 15 is a cross-sectional view of the display of FIGS. 13 and 14 with the liner removed and folded into an activated position.

FIGS. 13–15 illustrate another of the many different ways a clearing agent can be moved into operative engagement with a metal layer for activating our irreversible displays. The illustrated display 200 is activated by a folding action. A common base substrate 202 supports a metal layer 204 overlying a graphics layer 206 in one area and a chemical clearing agent 208 in another area. Both areas are surrounded by pressure-sensitive adhesive borders 212 and 214 and covered by a removable liner 216 having a release layer 218. The metal layer 204 is supported on a clear film 220, but like the earlier embodiments could be replaced by a self-supporting foil.

The clearing agent 208 preferably takes the form of a pressure-sensitive adhesive. Oxidants, acids, salts, or alkalis can be added to a conventional pressure-sensitive adhesive to adjust its efficacy for clearing the metal film 204; or the pressure-sensitive adhesive could be reformulated with mildly corrosive properties. The release layer 218 is preferably made of silicone, but other release materials having low adherence to the pressure-sensitive adhesive borders 212 and 214 and the clearing agent 208 could also be used.

A graphics layer 222 is laid out (e.g., printed) on the metal layer 204, in a pattern 224 that enhances viewing characteristics of the display 200. Preferably, the graphics layer 222 is composed of a buffer material as described in the earlier embodiments for delaying access of the clearing agent 208 to covered portions of the metal layer 204.

The display 200 is activated by removing the liner 216 and folding the substrate 202 about a fold line 226 to move the clearing agent 208 into contact with the metal film 204. The two pressure-sensitive adhesive borders 212 and 214 also contact each other for securing the display 200 in the folded position. The contact between the clearing agent 208 and any exposed portions 228 of the metal layer 204 triggers a spontaneous chemical reaction that clears the metal layer portions 228. Remaining portions 230 of the metal layer 204 are temporarily protected by the graphics layer 222 to regulate viewing access to the underlying graphics layer 206 in a stepwise or progressive fashion. Both the clearing agent 208 and at least the overlying portion of the folded substrate 202 are preferably transparent (or at least translucent) to provide a window for viewing the graphics layer 206, which is revealed by the disappearance of the metal film 204.

Other instructional or decorative graphics can be located elsewhere on the substrate 202 or the liner 216. For example, additional graphics could be used to block viewing of the graphics layer 206 through the base substrate 202. Also, the liner 216 could be limited to covering the clearing agent 208 in the unfolded position, and the clearing agent 208 alone (i.e., without the adhesive borders 212 and 214) could be used to subsequently secure the display 200 in the folded position.

Clearing agents can be brought into operative contact with metal layers of our irreversible displays in many other ways, including joining two substrates separately supporting the clearing agent and metal layer, removing liners separating overlapping layers of the clearing agent and metal, relatively moving overlapping layers of the clearing agent and metal layer together through a predefined space, releasing the clearing agent from encapsulation, or adding the clearing agent to an exposed portion of the metal layer. In addition, the clearing agent can be patterned to produce an initial image in the metal film.

More than one metal layer can be used together with additional graphic layers that provide differential access to the metal layers for providing additional overlapping stages of display. Viewing access to graphic layers hidden by the metal layer can take place through either the top substrate or the bottom substrate. Either or both of these substrates can be replaced by the films supporting the metal layers. The metal layers could also be supported on a variety of other substrates including paper, and the substrates can be modified, such as by etching or micro-embossing, to provide other visual or structural effects.

The irreversible displays described above can be used for a variety of purposes including stand-alone devices and display components of other products or devices. For example, the displays can be used as game pieces, message cards, security devices, condition detectors, or elapsed time indicators. Layers of adhesive and release can also be added to the substrates to incorporate the displays into pressure-sensitive labels or other printable products. The displays can also be formed as integral parts of the packaging of other products.

The displays can be switched from a first state in which the thin metal layer is opaque to a second state in which a predetermined area of the thin metal layer becomes substantially transparent, but the displays cannot be restored to the first state. The clearing that takes place in the thin metal layers to reveal indicia is irreversible. Preferably, the revealed indicia remain permanently displayed. Temporary or permanent indicia can also be formed as patterns in the metal layer itself. The indicia formed in the metal layer can also be used to transform, replace, contrast, or complete another overlying or underlying indicia.

The underlying indicia, which can range from a patch of color to patterns, symbols, or other more imaginative forms, is preferably formed prior to being overlain by the metal film. However, the indicia could also be formed later in an underlying medium (i.e., after the medium is covered by the metal film) by a developing mechanism, such as a thermal color-developing mechanism. Unique, timely, or interactive information could be printed on demand just prior to distribution or use.

The composition, amount, and physical properties (e.g., viscosity, yield value, and adhesion) of the chemical clearing agent can be adjusted to match the needs of particular applications. Similar characteristics of the buffer material, including its distribution on the metal layer can be adjusted to optimize display functions relating to both its own appearance and the controlled disappearance of the metal layer. Preferably, the buffer material is applied to the metal layer in the form of a graphics layer by conventional printing techniques. However, the graphics layer could also be applied to an adjacent substrate and later laminated or transferred to the metal layer.

The thin metal layers are preferably deposited onto one or more clear substrates, which are preferably transparent or at least translucent. Deposition methods include vacuum evaporation, cathode sputtering, electroplating, and various chemical reactions in a controlled atmosphere or electrolyte. In addition, the metal layers are preferably smooth, shiny, and thick enough to obscure the view of underlying layers. Thicknesses between 100 and 1000 Angstroms are preferred. Thicker metal layers, including at least partially self-supporting metal foils, can also be used, particularly for applications requiring slower clearing rates.

The individual substrates that provide support for the displays can be formed as single layers or as laminations for such purposes as providing color patterns, further rigidity, or better sealing capabilities. However, all of the substrates, including the substrate that normally supports the thin metal layer, are preferably supplied in rolls that can be unwound into an in-line press. Stress relief can be applied if the substrates are too inflexible for winding. All of the other layers, including the graphics layers, clearing agents, and the adhesives are preferably applied in patterns or injected into predetermined positions on one of the substrates by stations arranged along the press. Flexographic printing is preferred where possible, especially for laying down inks, but other printing techniques including extrusion or injection can be used where needed to lay down layers of clearing agent and adhesive.

The thin metal films are preferably pre-deposited onto substrates in advance of any press operations. However, thin metal film could also be transfer printed from a temporary carrier to the substrate along the press, such as by hot or cold stamping. For example, a thin metal film could be transferred from the temporary carrier by cold stamping in a pattern that matches an adhesive pattern on a substrate. Self-supporting metal foils could also be used if thin enough to clear within a required time span. Our preferred metal films are made of zinc, aluminum, or silver; but many other metals, including metal alloys, can be used.

Figure 16:
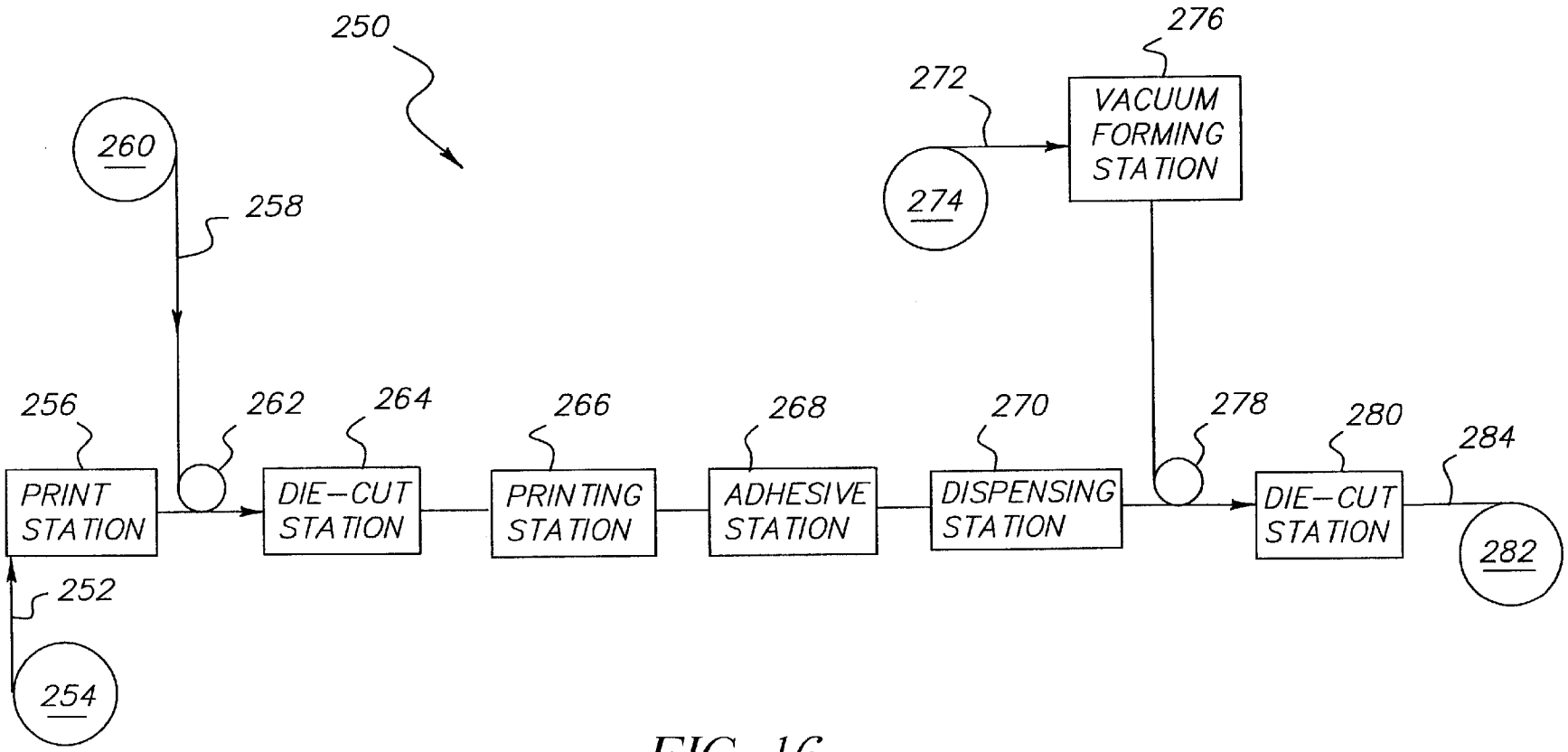
FIG. 16 is a diagram of an in-line press for manufacturing similar irreversible displays.

An exemplary in-line press 250 for making our irreversible displays, particularly the display of FIGS. 6–8, is depicted in FIG. 16. A bottom substrate (web) 252 is unwound from a roll 254 and advanced to a print station 256 that applies a graphics layer. A metal film 258, which includes a transparent supporting substrate (web), is unwound from a roll 260. A laminator 262 joins the metal film 258 to the bottom substrate 252, and die-cut station 264 cuts the metal film into a succession of patterns. An adhesive or other bonding agent can be used to secure the metal film 258 to the bottom substrate 252. The metal film 258 could also be mounted in a variety of other ways such as by transfer printing or by substituting a metal foil.

A printing station 266 applies a graphics layer on the metal film 258 using a buffer material having limited bonding characteristics. An adhesive station 268 applies adhesive in patterns surrounding both the successions of die-cut metal film and reservoirs (not shown) for confining a clearing agent. Thinner or otherwise weaker portions of the adhesive patterns form gated pathways (not shown) between the reservoirs and the die-cut metal film. A dispensing station 270 injects the clearing agent into the reservoirs. A transparent top substrate (web) 272 is unwound from a roll 274 and is directed through a vacuum forming station 276 for forming a succession of bulges through the top substrate 272 for increasing reservoir volumes. A laminator 278 joins the top and bottom substrates 272 and 252, sealing the clearing agent within the reservoirs. Heat sealing (not shown) can be used in combination with or as a substitute for the adhesive to join the two substrates together. Another die cut station 280 provides for at least partially dividing the combined webs 272 and 252 into individual displays in advance of a rewind station 282, completing a succession of roll-wound displays 284.

In place of reservoirs, successions of openings can be formed in the top substrate 272 to provide access to the metal film. Similar adaptations can be made for producing the other embodiments on press. For example, the metal film 258 could be laminated to the top substrate 272 instead of to the bottom substrate 252 to form the embodiment of FIGS. 1–5. Multiple metal films can be laminated together to form the embodiment of FIG. 10.

Such in-line processing can be used to produce successions of irreversible display cells in large volumes at low cost. Additional stations, such as die cutters, can be used to separate succeeding displays and to adapt the displays for their intended use as stand-alone displays or as displays incorporated within other products or product packages. A similar arrangement of in-line stations can be used to produce other embodiments of our displays including the addition or substitution of stations for applying layers such as barrier layers, protective layers, graphics layers, or layers of release. Additional rolls of substrates including liners and spacers can also be appended to the press.

We claim:

1. An irreversible multistage display comprising:

a metal layer having first and second portions;

a first graphics layer underlying both portions of the metal layer;

a second graphics layer laid out in a pattern on the first portion of the metal layer;

the first and second portions of the metal layer being differentially accessible to a chemical clearing agent that produces a chemical reaction for clearing the metal layer; and the first and second portions of the metal layer clearing at different rates for temporarily displaying the pattern of the second graphics layer in advance of more permanently displaying the first graphics layer.

2. The display of claim 1 in which a part of the first graphics layer made visible by clearing the second portion of the metal layer provides contrast for viewing the pattern of the second graphics layer in the first portion of the metal layer.

3. The display of claim 1 in which the second graphics layer is laid out using a material that influences the relative rates at which the first and second portions of the metal layer are cleared.

4. The display of claim 1 in which the metal layer includes a front surface remote from the first graphics layer and a back surface adjacent to the first graphics layer, and the second graphics layer is applied to the back surface of the metal layer.

5. The display of claim 1 in which the metal layer includes a front surface remote from the first graphics layer and a back surface adjacent to the first graphics layer, and the second graphics layer is applied to the front surface of the metal layer.

6. The display of claim 1 further comprising a third graphics layer laid out in a pattern on a third portion of the metal layer; and the first, second, and third portions of the metal layer clear at different rates to reveal a succession of different images.

7. The display of claim 1 in which the metal layer is a first of two metal layers.

8. The display of claim 1 in which the second graphics layer forms a block-out pattern to obscure the first graphics layer.

9. The display of claim 3 in which the second graphics layer material delays access of the chemical clearing agent to the first portion of the metal layer.

10. The display of claim 9 in which bonding characteristics of the second graphics layer material to the metal layer are adjusted to delay access of the clearing agent to the metal layer.

11. The display of claim 10 in which the second graphics layer material is an ink formulated to partially bond with the metal layer.

12. The display of claim 4 in which both the first and second graphic layers underlie the metal layer, and the pattern of the second graphics layer is temporarily revealed as a part of more completely revealing the first graphics layer.

13. The display of claim 4 further comprising a base substrate having a front surface adjacent to the back surface of the metal layer and a back surface remote from the back surface of the metal layer, and the first graphics layer is supported on the front surface of the base substrate.

14. The display of claim 13 in which the metal layer is deposited onto a substantially transparent film, and the metal layer and both graphics layers are located between the transparent film and the base substrate.

15. The display of claim 13 further comprising a space between the back surface of the metal layer and the front surface of the base substrate for exposing the metal layer to the clearing agent.

16. The display of claim 15 further comprising a reservoir for storing the clearing agent on the base substrate.

17. The display of claim 16 further comprising a gated pathway for conducting the clearing agent between the reservoir and the space between the metal layer and base substrate.

18. The display of claim 5 further comprising a base substrate having a front surface adjacent to the back surface of the metal layer and a back surface remote from the back surface of the metal layer, and the first graphics layer is located between the front surface of the base substrate and the back surface of the metal layer.

19. The display of claim 5 in which the metal layer is deposited onto a substantially transparent film that separates the metal layer from the first graphics layer.

20. The display of claim 5 in which the first graphics layer is applied to a substrate and the metal layer is deposited onto the first graphics layer.

21. The display of claim 6 in which the graphics layers are arranged to progressively evolve from one image to another.

22. The display of claim 7 in which the first graphics layer is located between the two metal layers.

23. An irreversible display system that temporarily displays an indicium comprising:

a metal layer and a chemical clearing agent maintained out of operative contact with each other within a display region;

a pattern on the metal layer within the display region for forming the indicium;

the clearing agent being relatively moveable into operative contact with the metal layer within the display region for initiating a chemical reaction for clearing the metal layer; and the pattern being composed of a buffer material that delays clearing of the patterned portion of the metal layer with respect to a remaining portion of the metal layer to temporarily display the indicium.

24. The display system of claim 23 in which the buffer material is printed on the metal layer.

25. The display system of claim 23 in which the pattern is a first of at least two patterns and the buffer material is a first of at least two buffer materials arranged for delaying clearing of the two patterned portions by different amounts.

26. The display system of claim 23 in which the metal layer has a front surface exposed to view within the display region, a back surface obscured from view within the display region, and the pattern is formed on the back surface of the metal layer.

27. The display system of claim 23 in which the metal layer has a front surface exposed to view within the display region, a back surface obscured from view within the display region, and the pattern is formed on the front surface of the metal layer.

28. The display system of claim 23 in which the metal layer is no more than 1000 Angstroms thick.

29. The display system of claim 23 in which the metal layer is deposited onto a substrate and a more permanent image is located between the metal layer and the substrate.

30. The display system of claim 23 in which the metal layer is a first of two metal layers maintained out of operative contact with the clearing agent within a display region.

31. A method of activating the display system of claim 23 comprising a step of relatively moving the clearing agent into operative contact with the surface of the metal layer.

32. The display system of claim 24 in which the buffer material contains an anti-bonding agent that reduces adherence of the buffer material to the metal layer.

33. The display system of claim 32 in which the buffer material is an ink.

34. The display system of claim 25 in which the buffer materials exhibit different bonding characteristics with the metal layer.

35. The display system of claim 26 further comprising a base substrate having a front surface adjacent to the back surface of the metal layer and a back surface remote from the back surface of the metal layer, and a space between the back surface of the metal layer and the front surface of the base substrate provides for moving the clearing agent into operative contact with the metal layer within the display region.

36. The display system of claim 35 in which the metal layer is deposited onto a substantially transparent film, and the metal layer and the pattern are located between the transparent film and the base substrate.

37. The display system of claim 35 in which a more permanent image is supported on the base substrate within the display region and is revealed by the clearing of the metal layer.

38. The display system of claim 27 further comprising a base substrate having a front surface adjacent to the back surface of the metal layer and a back surface remote from the back surface of the metal layer, and a more permanent image that is located between the back surface of the metal layer and the front surface of the base substrate within the display region and is revealed by the clearing of the metal layer.

39. The display system of claim 28 in which the metal layer is made of zinc.

40. The display system of claim 39 in which the metal layer is deposited onto a substantially transparent substrate.

41. The display system of claim 39 in which a more permanent image is located between the two metal layers.

42. The method of claim 41 including a further step of delaying the clearing of the patterned portion of the metal layer with respect to a remaining portion of the metal layer within the display region.

43. A method of temporarily displaying an indicium with an irreversible display comprising the steps of:

supporting a metal layer having a first and second portions within a display region, the first portion being covered by buffering material in a form of an indicium;

engaging a chemical clearing agent with the metal layer within the display region; and producing an electrochemical reaction between the chemical clearing agent and the metal layer that clears the first and second portions of the metal layer at different rates for temporarily displaying the indicium.

44. The method of claim 43 in which the step of producing clears the second portion of the metal layer in advance of clearing the first portion of the metal layer.

45. The method of claim 43 in which the step of producing clears the first and second portions of the metal layer without generating an electromotive force beyond the clearing agent.

46. The method of claim 43 in which the clearing of the first and second portions of the metal layer reveals another more permanent indicium that underlies the metal layer.

47. The method of claim 43 in which the step of engaging includes applying the clearing agent in a liquid form to the metal layer.

48. The method of claim 43 in which the step of engaging includes applying the clearing agent in a gelatin form to the metal layer.

49. The method of claim 43 in which the step of engaging includes applying the clearing agent in an adhesive form to the metal layer.

50. The method of claim 43 including a further step of formulating the buffering material to include limited bonding characteristics with the first portion of the metal layer.

51. The method of claim 43 including a further step of printing the buffering material onto the first portion of the metal layer.

52. A method of irreversibly displaying a sequence of images comprising the steps of:

producing an electrochemical reaction between a chemical clearing agent and a metal layer without inducing a net flow of current in the metal layer;

clearing a portion of the metal layer as a result of the electrochemical reaction to display a temporary image formed in the metal layer; and subsequently clearing a remaining portion of the metal layer as a further result of the electrochemical reaction to reveal a more permanent image that underlies the metal layer.

53. The method of claim 52 in which the step of subsequently clearing includes clearing the remaining portion of the metal layer in which the temporary image is formed.

54. The method of claim 52 in which the temporary image is defined in the metal layer by a buffering material that retards access of the chemical clearing agent to the metal layer.

55. The method of claim 52 in which the step of clearing includes clearing portions of the metal layer at different rates to display a succession of temporary images formed in the metal layer.

56. The method of claim 55 in which the succession of temporary images are defined by different buffering materials that regulate access rates of the chemical clearing agent to the metal layer.

57. An irreversible display activated by the interaction of a chemical clearing agent with a metal layer comprising:

the metal layer;

a display window aligned with the metal layer;

an indicium aligned with the display window and obscured by the metal layer; and a buffer layer covering the metal layer within the display window for regulating access of the chemical clearing agent to the metal layer.

58. The display of claim 57 in which the buffer layer delays access of the chemical clearing agent to the metal layer, wherein such access results in a clearing of the metal layer to reveal the indicium within the display window.

59. The display of claim 57 in which the buffer layer has limited bonding characteristics with the metal layer for delaying access of the clearing agent to the metal layer.

60. The display of claim 58 in which the buffer layer is applied in a pattern to the metal layer to delay clearing of the pattern in the metal layer.

61. The display of claim 58 in which the chemical clearing is maintained in a dormant state in contact with the buffer layer.

62. The display of claim 60 in which the buffer layer provides for displaying the pattern in the metal layer in advance of more completely displaying the indicium.

63. The display of claim 61 in which the chemical clearing agent is frozen.

64. The display of claim 63 in which the buffer layer is made of an ink having reduced bonding characteristics with the metal film.

* * * * *